US011598136B2

(12) United States Patent
Güzeltepe et al.

(10) Patent No.: US 11,598,136 B2
(45) Date of Patent: Mar. 7, 2023

(54) FURNITURE HINGE WITH DAMPING ADJUSTMENT

(71) Applicant: Samet Kalip Ve Maden Esya San. Ve Tic. A.S., Istanbul (TR)

(72) Inventors: Nurettin Güzeltepe, Istanbul (TR); Artur Hirtsiefer, Neunkirchen-Seelscheid (DE)

(73) Assignee: Samet Kalip Ve Maden Esya San. Ve Tic. A.S.

( * ) Notice: Subject to any disclaimer, the term of this patent is extended or adjusted under 35 U.S.C. 154(b) by 178 days.

(21) Appl. No.: 17/296,226

(22) PCT Filed: Nov. 4, 2019

(86) PCT No.: PCT/TR2019/050921
§ 371 (c)(1),
(2) Date: May 22, 2021

(87) PCT Pub. No.: WO2020/112057
PCT Pub. Date: Jun. 4, 2020

(65) Prior Publication Data

US 2022/0018176 A1 Jan. 20, 2022

(30) Foreign Application Priority Data

Nov. 30, 2018 (TR) ..... 2018/18261

(51) Int. Cl.
*E05F 1/08* (2006.01)
*E05F 3/18* (2006.01)
(Continued)

(52) U.S. Cl.
CPC ..... *E05F 3/18* (2013.01); *E05D 3/06* (2013.01); *E05F 3/20* (2013.01); *E05Y 2900/20* (2013.01)

(58) Field of Classification Search
CPC ..... E05F 1/12; E05F 1/1276; E05F 1/1246; E05F 1/1253; E05F 1/1261; E05F 1/1058;
(Continued)

(56) References Cited

U.S. PATENT DOCUMENTS 8,321,996 B2 * 12/2012 Hirtsiefer ..... E05F 5/02 16/354
9,719,283 B2 8/2017 Holzapfel
(Continued)

FOREIGN PATENT DOCUMENTS

DE 202008010012 U1 11/2008
DE 202010015094 U1 * 3/2012 ..... E05D 11/00
(Continued)

OTHER PUBLICATIONS

International Search Report and Written Opinion of corresponding PCT/TR2019/050921, dated Apr. 24, 2020, 8 pages (not prior art).

*Primary Examiner* — Chuck Y Mah
(74) *Attorney, Agent, or Firm* — Lucian Wayne Beavers; Nathan I. North; Patterson Intellectual Property Law, PC

(57) ABSTRACT

The present invention relates to a furniture hinge that is suited for changing damping course of the furniture door in the closing direction. The inventive furniture hinge comprises; a housing; a hinge arm that is connected to the furniture door from the one end and connected to said housing in an axially rotatable manner from the other end by means of a first rotating pin; a power unit having at least one spring that creates force on said hinge arm, and that is connected between a lever arm that is capable of accommodating a power adjustment thereon and a third rotating pin in an axially rotatable manner; a movement arm that is connected to said hinge arm from one end in an axially rotatable manner, that is connected to said lever arm from the other end in an axially rotatable manner, and that enables the power transmission between said power unit and hinge
(Continued)

arm; a damping element located on said lever arm for damping the furniture door that is being closed over the furniture body; and a damping adjustment on said lever arm for the purpose of changing the position of a cylinder belonging to the damping element with respect to the lever arm.

10 Claims, 3 Drawing Sheets

(51) Int. Cl.
*E05D 3/06* (2006.01)
*E05F 3/20* (2006.01)

(58) Field of Classification Search
CPC ... E05F 1/1075; E05F 3/04; E05F 5/02; E05F 3/20; E05F 3/06; E05F 3/18; E05D 3/06; E05D 3/16; E05D 11/00; E05D 15/40; E05D 2003/163; E05Y 2201/10; E05Y 2201/256; E05Y 2201/21; E05Y 2201/264; E05Y 2201/47; E05Y 2201/492; E05Y 2900/20; E05Y 2900/202; E05Y 2600/10; E05Y 2600/41; A47B 2220/0072; Y10T 16/5383; Y10T 16/547; Y10T 16/5476
See application file for complete search history.

(56) References Cited

U.S. PATENT DOCUMENTS

| | | | | |
|---|---|---|---|---|
| 10,407,962 | B2 | 9/2019 | Schluge | |
| 10,876,336 | B2 * | 12/2020 | Kruedener | E05D 5/02 |
| 10,914,106 | B2 * | 2/2021 | Salice | E05F 3/106 |
| 2001/0039762 | A1 | 11/2001 | Giovannetti | |
| 2007/0124893 | A1 | 6/2007 | Brustle | |
| 2010/0101052 | A1 | 4/2010 | Waltemate et al. | |
| 2010/0109497 | A1 | 5/2010 | Blersch et al. | |
| 2013/0333291 | A1 | 12/2013 | Blum | |
| 2014/0317883 | A1 * | 10/2014 | Baldreich | E05F 1/1261 16/280 |
| 2016/0333620 | A1 | 11/2016 | Holzapfel | |
| 2017/0044812 | A1 | 2/2017 | Schluge | |
| 2017/0292307 | A1 | 10/2017 | Hirtsiefer et al. | |
| 2018/0291665 | A1 * | 10/2018 | Güzeltepe | E05F 1/1041 |
| 2019/0106918 | A1 * | 4/2019 | Schmid | E05D 7/125 |
| 2020/0123831 | A1 * | 4/2020 | Xu | E05D 3/16 |
| 2020/0362612 | A1 * | 11/2020 | Nordieker | E05D 3/16 |

FOREIGN PATENT DOCUMENTS

| | | | |
|---|---|---|---|
| DE | 202014102481 | U1 | 10/2015 |
| EP | 3091160 | B1 | 1/2018 |
| WO | 2015135005 | A1 | 9/2015 |
| WO | 2015164894 | A1 | 11/2015 |

* cited by examiner

FURNITURE HINGE WITH DAMPING ADJUSTMENT

TECHNICAL FIELD OF THE INVENTION

The present invention relates to a furniture hinge with a damping adjustment that enables damping of a furniture door, which is adjustable between open and closed positions on a furniture body, at different positions in the closing direction thereof.

The inventive furniture hinge comprises; a hinge arm that can be connected to the furniture door and that is axially rotatable on the housing by means of a first rotating pin; a movement arm that is connected between said hinge arm and a lever arm which is axially rotatable by means of a second rotating pin; a power unit that is connected between said lever arm and a third rotating pin; and a damping adjustment that enables damping of the furniture door at different positions in the closing direction.

PRIOR ART

Furniture hinges that are allowably designed for damping the furniture door at different positions or forces are known from the patent document numbered WO2015164894. Furniture hinge disclosed in the abovementioned patent document allows for adjusting the damping force by means of an adjusting apparatus. Furniture hinge disclosed herein comprises; an hinge arm; a spring apparatus for applying force to the hinge arm; a transmission mechanism for transmitting a force of the spring apparatus onto the hinge arm; an adjusting apparatus by means of which a lever geometry of the transmission mechanism and/or the force of the spring apparatus can be adjusted; and a damping apparatus by means of which a movement of the hinge arm can be damped. Said adjusting apparatus envisaged for adjusting the spring force is in connection with the damping apparatus. Damping position and/or damping force of said damping apparatus are also adjusted by means of adjusting said adjusting apparatus through a coupling apparatus. Both the spring force and the damping force are adjusted by means of said adjusting apparatus.

Another document regarding damping adjustment in furniture hinges is the utility model document numbered DE 20 2014 102481 U1. Furniture hinge disclosed in said utility model document comprises a damping device wherein said damping device further contains a damping apparatus for damping the hinge arm and a housing. Said damping device may temporarily come into contact with a movable portion of the hinge arm. Said furniture hinge has a key apparatus. The piston of the damping device is kept in a pushed position inside the housing by means of said key apparatus. While the piston is in the pushed position, said damping device cannot come into contact with the movable portion located on the hinge arm. Therefore, the damping function of the hinge arm is turned off. Furniture hinge disclosed in said document proposes a key structure that allows for switching the damping function on or off rather than a damping adjustment.

The inventive furniture hinge comprises a damping adjustment being arranged independent from power adjustment. Thus, damping force can be adjusted safely and easily according to furniture doors that are of different weights and sizes.

Said damping adjustment is easily accessible and adjustable without removing the housing during the adjustment. By means of an easily accessible adjustment, damping force or the position in which the damping will begin can be readily determined through a simple adjustment tool such as a screwdriver.

Operation principle of the inventive damping adjustment involves linearly moving a single adjustment piece on the lever arm by using an adjustment tool, e.g. a screwdriver, and changing the damping course of a damping element on the lever arm through said linear movement. The inventive damping adjustment which offers a simple and an easy adjustment opportunity aims to minimize problems and failure risks posed by a complex adjustment mechanism.

BRIEF DESCRIPTION OF THE INVENTION

The present invention achieves the object of adjusting damping position/angle of a furniture door in the closing direction thereof by means of a furniture hinge comprising a damping adjustment on the lever arm.

The inventive furniture hinge comprises; a housing; a hinge arm that is connected to the furniture door from the one end and connected to said housing in an axially rotatable manner from the other end by means of a first rotating pin; a power unit having at least one spring that generates force on said hinge arm, and that is connected between a lever arm that is capable of accommodating a power adjustment thereon and a third rotating pin in an axially rotatable manner; a movement arm that is connected to said hinge arm from one end in an axially rotatable manner, that is connected to said lever arm from the other end in an axially rotatable manner, and that enables the power transmission between said power unit and hinge arm; a damping element located on said lever arm for damping the furniture door that is being closed over the furniture body; and a damping adjustment on said lever arm for the purpose of changing the position of a cylinder belonging to the damping element with respect to the lever arm.

Said damping adjustment comprises an adjustment piece. Damping course of the damping element is changed by means of said adjustment piece. Said adjustment piece allows for changing the position of a sliding element which can move linearly on the lever arm with respect to the lever arm. Said sliding element moves together with the cylinder of the damping element. Said sliding element moves together with the adjustment piece on the lever arm.

The inventive furniture hinge comprises a power adjustment on said lever arm so that it may compatibly function with furniture doors that are of different weights. Connection point of the power unit to the lever arm can be changed by means of aforementioned power adjustment. In a preferred embodiment of the present invention, said power adjustment comprises a threaded screw that is positioned on the lever arm in an endless axially rotatable manner, and on which a holder is movable. Said power adjustment preferably comprises an adjustment element that is accessible by an external adjusting tool such as a screwdriver. The force that will be applied to furniture doors which are of different weights, velocities and sizes may be balanced by means of adjusting the position of the holder located on the endless-rotatable threaded screw through said adjustment element.

In a preferred embodiment of the present invention, said furniture hinge may comprise an opening angle adjustment that determines the final opening position in the upward direction of the furniture door. Said opening angle adjustment may comprise an axially rotatable adjustment means and a body which can move linearly through the axial rotation of said adjustment means. Said opening angle adjustment may convert the axial rotation of the adjusting means into the linear motion of the body. Said opening angle adjustment may be supported by means of a support piece.

The inventive furniture hinge may comprise a damper that is positioned on said body, and that functions in unison with a stopping element on said movement arm for damping the furniture door in the opening direction. When the furniture door is opened swiftly in the opening direction, said damper meets a stopping element belonging to said movement arm and can accordingly slow the furniture door down along the damping course. Once the damping course comes to an end, the furniture door may reach the final opening position in the opening direction.

Said damper may be foreseen in a manner in which it may linearly move together with the body belonging to the opening angle adjustment. Damper's position may also be changed by means of changing the body position which is changed over said adjustment means and thus, the damping point and/or the final opening position of the furniture door may be adjusted.

Said furniture hinge is capable of retaining the furniture door at any intermediate position between open and closed positions on the furniture body.

The inventive furniture hinge is disclosed in detail below together with reference numerals over an embodiment illustrated in annexed figures.

DETAILED DESCRIPTION OF THE FIGURES

REFERENCE NUMERALS

10 Furniture Hinge
11 Furniture Body
12 Furniture Door
20 Hinge Arm
21 First Rotating Pin
22 Protrusion
30 Sliding Element
31 Damping Adjustment
32 Adjustment Piece
33 Damping Element
33.1 Cylinder
33.2 Piston Rod
33.3 Contact Surface
34 Support Surface
40 Lever Arm
41 Second Rotating Pin
42 Projection
43 Power Adjustment
44 Adjustment Element
45 Gaps
46 Stopper
47 Threaded Screw
50 Housing
51 Mounting Plate
51.1, 51.2, 51.3, 51.4, 51.5, 51.6, 51.7 Fixing Recesses
52 Screw
53 Connection Portions
60 Movement Arm
61 Plate
62 First Joint
63 Second Joint
64 Stopping Element
70 Support Piece
71.1, 71.2, 71.3, 71.4, 71.5, 71.6, 71.7 Mounting Recesses
80 Power Unit
81 First Casing
82 Second Casing
83 Third Rotating Pin
84 Spring
85 Connection Element
86 Holder
90 Opening Angle Adjustment
91 Body
92 Adjusting Means

DETAILED DESCRIPTION OF THE INVENTION

Figure 1:
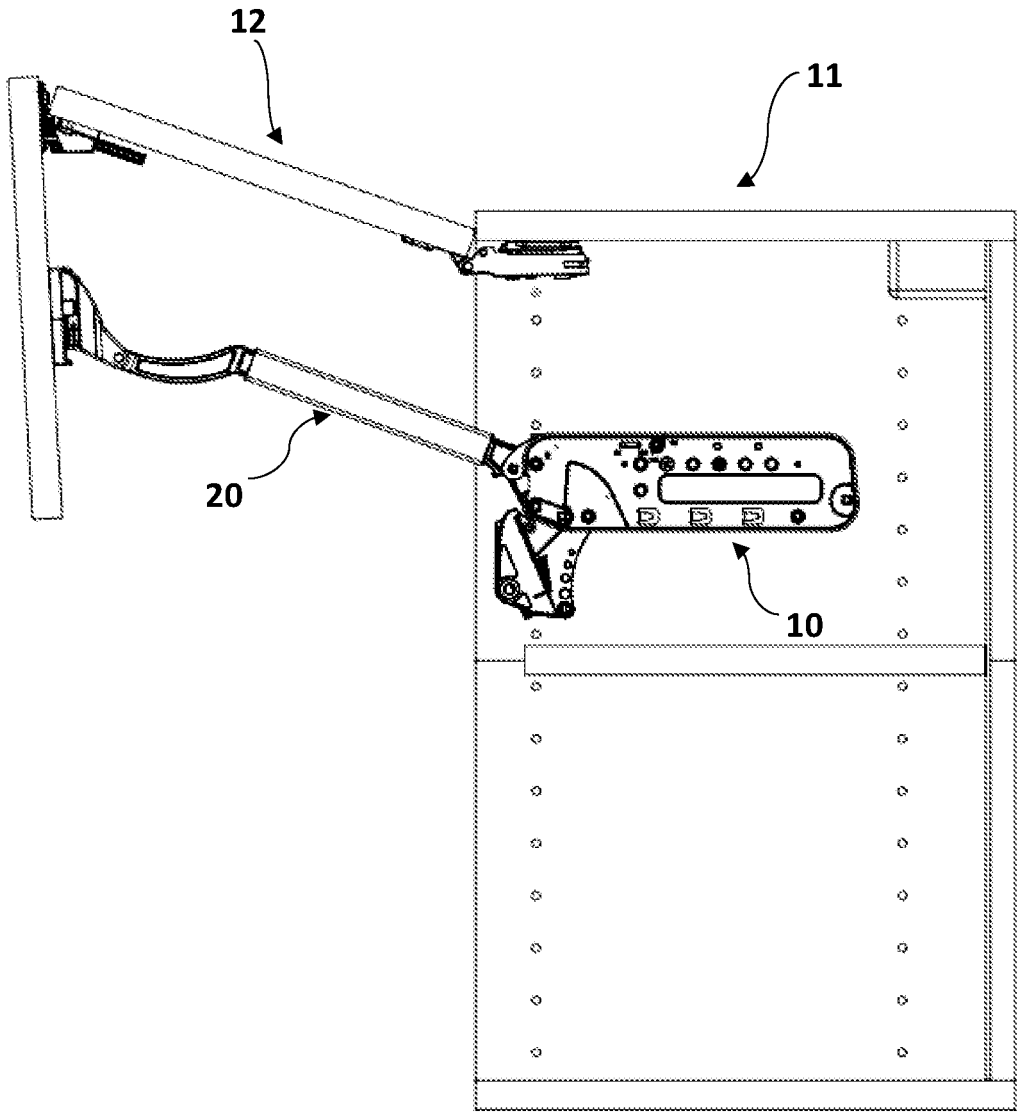
FIG. 1 shows a view of the furniture hinge according to the present invention wherein the inventive furniture hinge is mounted on a furniture.

FIG. 1 shows the furniture hinge (10) of the invention in a manner in which the furniture hinge is attached to a furniture body (11) wherein the hinge arm (20) holds the furniture door (12) in an open position at any intermediate location.

Figure 2:
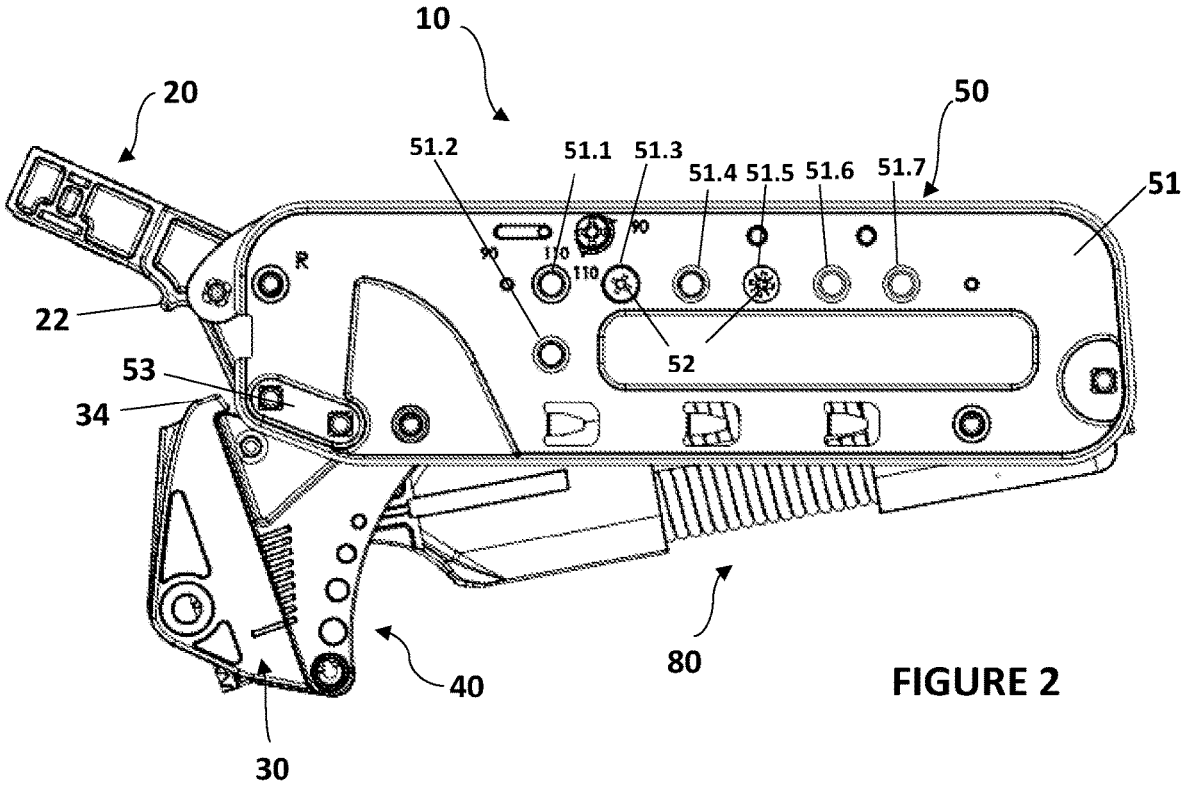
FIG. 2 shows the perspective view of the furniture hinge shown in FIG. 1 wherein the inventive furniture hinge is detached from the furniture.

FIG. 2 shows the furniture hinge (10) of the invention together with housing (50) positioned thereon. Said housing (50) carries the parts located on the furniture hinge (10) and it is also utilized for the connection of the furniture hinge (10) to the furniture body (11).

Said housing (50) comprises two reciprocally positioned mounting plates (51) wherein elements of the furniture hinge (10) are carried therebetween. Said mounting plates (51) are connected to one another over a support piece (70) in a manner that there is a distance therebetween (FIG. 3).

Said mounting plates (51) comprises seven fixing recesses (51.1, 51.2, 51.3, 51.4, 51.5, 51.6, 51.7) that are formed so as to ensure that these recesses will correspond to one another. The number of said fixing recesses (51.1, 51.2, 51.3, 51.4, 51.5, 51.6, 51.7) may be selected to be more or less than seven. The furniture hinge (10) is mounted on the furniture body (11) by means of fixing recesses (51.1, 51.2, 51.3, 51.4, 51.5, 51.6, 51.7) and by screws (52) that are passed through mounting recesses (71.1, 71.2, 71.3, 71.4, 71.5, 71.6, 71.7) corresponding to them on said support piece (70). Based on the user preference, the furniture hinge (10) may be screwed on the furniture body (11) by using the entirety or a few of said fixing recesses (51.1, 51.2, 51.3, 51.4, 51.5, 51.6, 51.7) and mounting recesses (71.1, 71.2, 71.3, 71.4, 71.5, 71.6, 71.7). In the representative embodiment being provided in FIG. 2 and FIG. 3, preferably two screws are utilized for the connection of the furniture hinge (10).

Figure 3:
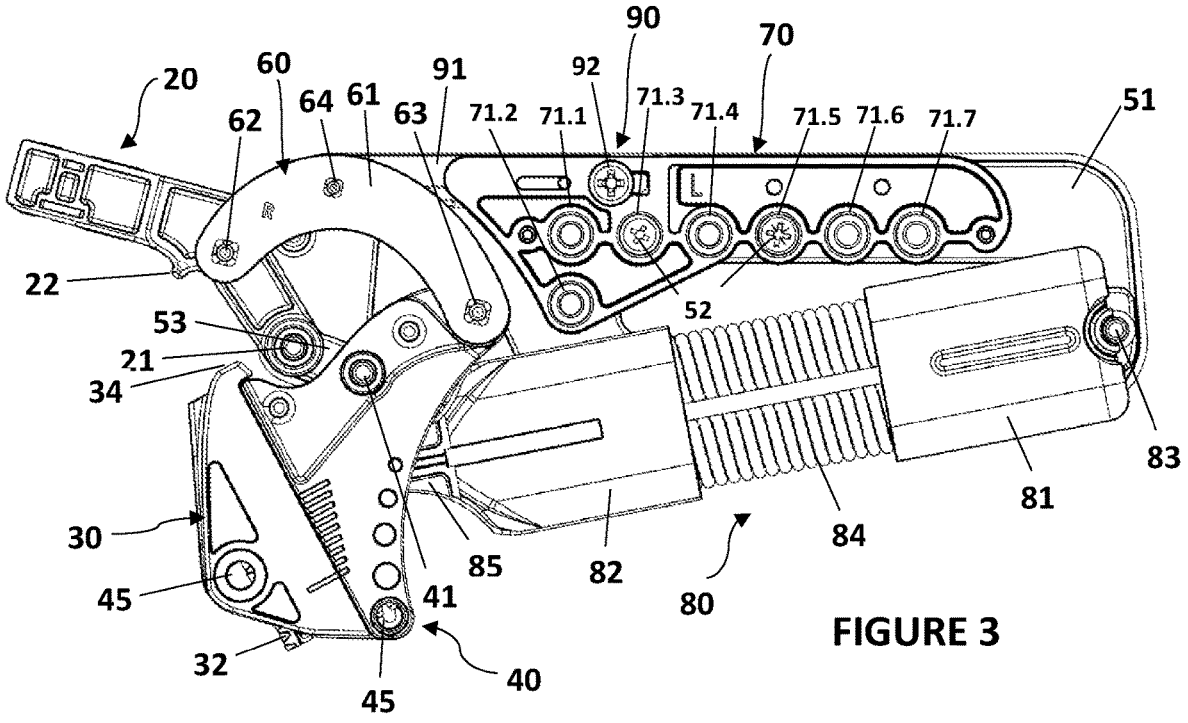
FIG. 3 shows the perspective view of the furniture hinge shown in FIG. 2 wherein one of the mounting plates of the housing is removed.

FIG. 3 shows a view illustrating the internal mechanism and the other rear mounting plate (51) of the furniture hinge (10) wherein one of the mounting plates (51) is removed.

As it can be seen in FIG. 2 or FIG. 3, the hinge arm (20) of the furniture hinge (10) is connected in an axially rotatable manner between mounting plates (51) of said housing (50) by means of a first rotating pin (21). By "axially rotatable" it is meant that the element is rotatable about an axis of rotation. Said first rotating pin (21) is riveted on the reciprocally positioned mounting plates (51) at both ends. Connection portions (53) are provided on each of the mounting plates (51) in order to ensure the connection of said first rotating pin (21) to the mounting plates (51). Said connection portions (53) may be formed either by means of bending of the mounting plate (51) therein or by connecting (welding) an additional piece on the respective portion of the mounting plate (51). Thus, the connection of said hinge arm (20) can be securely mounted between the mounting plates (51). Said hinge arm (20) can be connected in an axially rotatable manner between mounting plates (51) or it may also be directly or indirectly connected to the furniture door (12) from the other end thereof (FIG. 1).

Said hinge arm (20) can be provided as having a variable length, preferably in a telescopic structure. Thus, the furniture hinge (10) is rendered compatible to be used in furniture of different sizes. Since the hinge arm (20) has a variable length, the furniture hinge (10) which can be utilized in cabinets with foldable doors illustrated in FIG. 1, may become compatible for use in single-door cabinets with a simple adjustment to be made in the length of the hinge arm (20). Opting for a hinge arm (20) of this type may facilitate making adjustments including height, depth, etc.

As it can be seen in FIG. 3, said hinge arm (20) is directly or indirectly connected to a movement arm (60) of the furniture hinge (10) from an end thereof by means of a first joint (62) in an axially rotatable manner. Said movement arm (60) is comprised of two reciprocally positioned plates (61). FIG. 3 shows one of said plates (61). Other plate (61) is connected to the other side of the hinge arm (20) via said first joint (62). These plates (61) may preferably be in C form. Said movement arm (60) is connected to a lever arm (40) of the furniture hinge (10) from another end by means of a second joint (63) in an axially rotatable manner. The plates (61) of said movement arm (60) are reciprocally connected to said hinge arm (20) via the first joint (62) and to said lever arm (40) via the second joint (63) in an axially rotatable manner. Said movement arm (60) ensures force transmission between the furniture door (12) and the power unit (80).

Said movement arm (60) may comprise a stopping element (64). Preferably, said stopping element (64) may be a pin extending between two reciprocally positioned plates (61). As said stopping element (64) reinforces the connection of both plates (61), it may also start the damping of the furniture door (12) in upward direction by coming into contact with a damper while the furniture door (12) is being opened in upward direction.

As it can be seen in FIG. 3, said lever arm (40) is connected to said housing (50) in an axially rotatable manner between said mounting plates (51) by means of a second rotating pin (41). Connection of said second rotating pin (41) to the mounting plates (51) may be established over the connection portion (53). Thus, connection of the lever arm (40) to the mounting plates (51) may be established in a secure manner.

Figure 4:
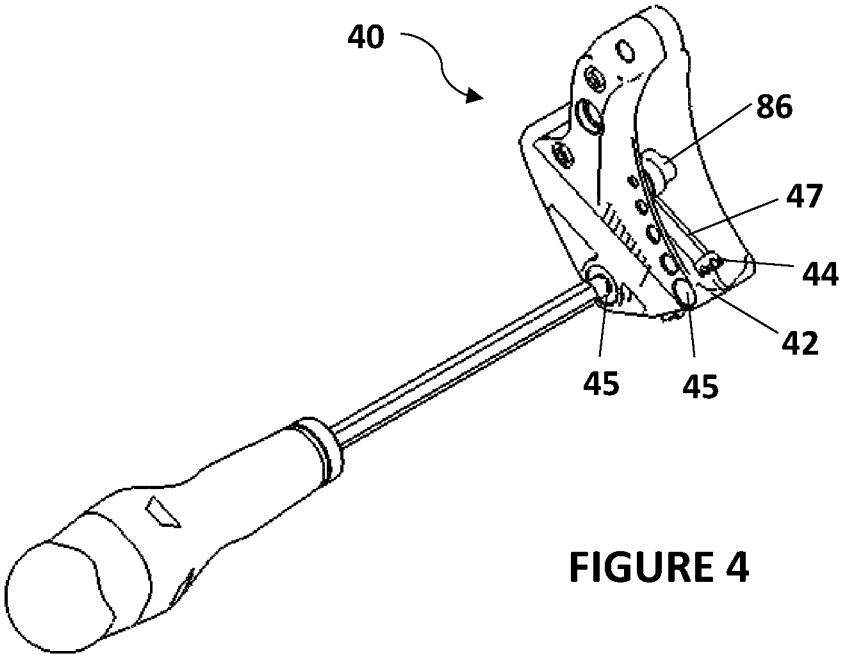
FIG. 4 shows the perspective view of the inventive furniture hinge wherein the lever arm of the inventive furniture hinge is being provided separately from the furniture hinge and wherein the damping adjustment is being made by means of an adjustment tool in a representative manner.
Figure 5:
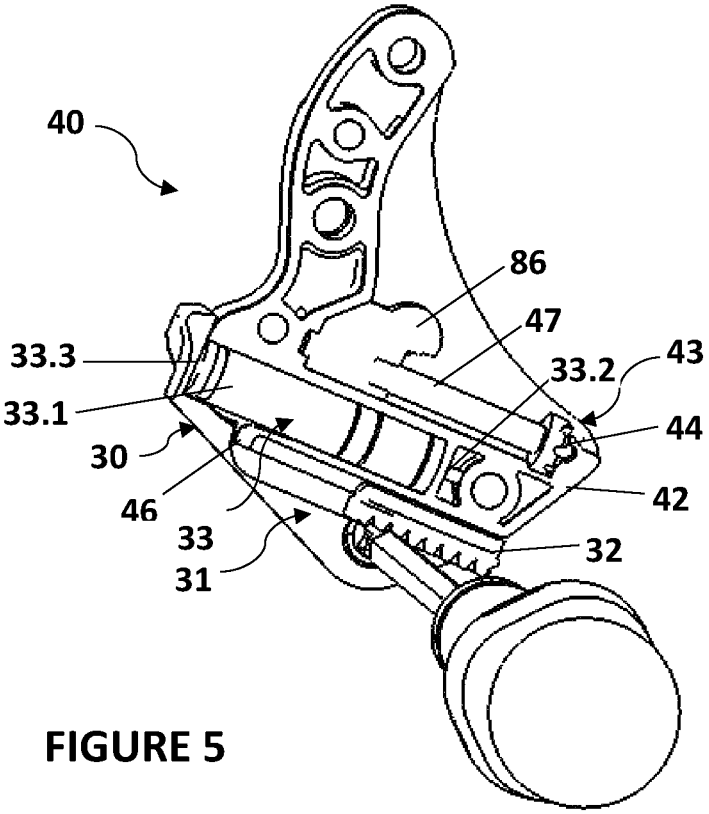
FIG. 5 shows the sectional view of the lever arm shown in FIG. 4 from a different angle.

Said lever arm (40) is separately shown in FIG. 4. FIG. 5 is the sectional view of the lever arm (40) provided in FIG. 4. As it can be seen in FIG. 5, said lever arm (40) comprises a projection (42). A power adjustment (43) is provided on said projection (42). Said power adjustment (43) comprises an adjustment element (44) and a threaded screw (47) that is connectable to the adjustment element (44). Said threaded screw (47) is positioned to a seat located on the projection (42) in a manner in which the threaded screw (47) may rotate freely and continuously but does not create reciprocating motion when said adjustment element (44) is rotated. There is provided a holder (86) which may advance on said threaded screw (47) while it is rotating. Said holder (86) may be a nut having a threaded inner surface. Said holder (86) is in connection with a power unit (80).

As it can be seen in FIG. 2 or FIG. 3, said lever arm (40) has a sliding element (30) that can be linearly moved on said projection (42). Said sliding element (30) cooperates with a protrusion (22) located on the hinge arm (20).

As it is illustrated in FIG. 5, said lever arm (40) comprises a damping adjustment (31) on said projection (42). Said damping adjustment (31) comprises an adjustment piece (32). Above-mentioned adjustment piece (32) has a threaded or toothed structure on its lower edge as seen in FIG. 5. While damping adjustment is being made, the sliding element (30) that is connected to said adjustment piece (32) can linearly move on said projection (42) by means of rotating a screwdriver engaging the adjustment piece (32).

Said lever arm (40) comprises a damping element (33) located on said projection (42). Said damping element (33) comprises a cylinder (33.1) in which a piston can move linearly. Said damping element (33) may be a damping element (33) with liquid flow or air flow. Damping element (33) further comprises a piston rod (33.2). The piston rod (33.2) is in connection with the piston inside the cylinder (33.1) from one end and with the lever arm (40) from the other end. Said cylinder (33.1) is in contact with the sliding element (30) over a contact surface (33.3). While the furniture door (12) is being closed, linear movement of the sliding element (30) on the projection (42) also moves the cylinder (33.1) linearly on the piston rod (33.2). Damping course of the damping element (33) and accordingly of the furniture door (12) in the closing direction is adjusted by means of said damping adjustment (31). The angle in which the damping in the closing direction will start refers to damping course of the damping element (33). Said sliding element (30) and said protrusion (22) are in contact with one another in the course of damping in the closing direction (along the damping course).

Said damping element (33) comprises a compression spring that retains the cylinder (33.1) at a main position on the piston rod (33.2). The sliding element (30) continuously is in contact with the damping element (33) over the contact surface (33.3) of the cylinder by means of said compression spring. While the furniture door (12) is being opened, linear movement of the sliding element (30) on the projection (42) in the opposite direction of the damping direction also moves the cylinder (33.1) linearly on the piston rod (33.2) in the opposite direction of the damping direction by means of the compression spring. While the furniture door (12) is being closed, linear movement of the sliding element (30) on the projection (42) in the damping direction also moves the cylinder (33.1) linearly on the piston rod (33.2) in the damping direction.

In case where the damping course is being adjusted, sliding element (30) engages the contact surface (33.3) and slides the cylinder (33.1) on the piston rod (33.2) in the opposite direction of the damping direction when the adjustment piece (32) is linearly moved on the sliding element (30) in the damping direction by rotation of an adjustment tool (screwdriver). Thus, the damping course of the damping element (33) is increased. Inversely, it is also possible to decrease the damping course by means of the adjustment piece (32).

Said lever arm (40) comprises a stopper (46) for limiting the movement of the sliding element (30) in the opposite direction of the damping direction. While the furniture door (12) is switched to open position from closed position, cylinder (33.1) tries to move into its main position by sliding on the piston rod (33.2) in the opposite direction of the damping direction by means of the compression spring of the damping element (33). When the protrusion (22) removes pressure on the support surface (34), sliding element (30) slides on the lever arm (40) in the opposite direction of the damping direction together with the cylinder (33.1). Sliding element's (30) movement in this direction is limited by means of said stopper (46).

As it can be seen in FIG. 2 or FIG. 3, said sliding element (30) comprises a support surface (34) that cooperates with the protrusion (22) located on the hinge arm (20). When the furniture door (12) is moved in the closing direction, as of the moment (angle) in which the damping in the closing direction will begin, said protrusion (22) presses onto said support surface (34) and it starts the damping of the furniture door (12) in the closing direction.

When the furniture door (12) is moved in the opening direction, cylinder (33.1) moves in the opposite direction of the damping direction on the piston rod (33.2), namely returns to the main position by means of the compression spring located inside the cylinder (33.1) and the sliding element (30) moves in the opposite direction of the damping direction therewith.

While the furniture door (12) is being closed, when said protrusion (22) presses onto the support surface (34) located on the sliding element (30), sliding element (30), the cylinder (33.1) and the adjustment piece (32) move together in the damping direction as a group. Inversely, while the furniture door (12) is being switched from closed position to open position, adjustment piece (32), cylinder (33.1) and sliding element (30) move together in the opposite direction of the damping direction as a group. Adjustment piece (32), sliding element (30) and cylinder (33.1) continue moving in this direction together until said adjustment piece (32) leans on said stopper (46). Once the adjustment piece (32) leans on said stopper (46) said protrusion (22) separates from the support surface (34). Thus, the sliding element (30) remains in this position.

While the furniture door (12) is being opened, damping element (33) which is released after the pressure of the protrusion (22) onto the support surface (34) is interrupted, returns to its main position by means of the compression spring. Once the damping element is back at its main position, contact between the protrusion (22) and support surface (34) gets interrupted. Said adjustment piece (32) moves together with said sliding element (30).

Said lever arm (40) is configured to be of two pieces and preferably of symmetrical two pieces in a manner to include the damping element (33), power adjustment (43) and the holder (86) therebetween. As it can be seen in FIG. 4, the adjustment element (44) of the power adjustment (43) and the adjustment piece (32) of the damping adjustment (31) may be accessed through the gaps (45) located on said lever arm (40) by means of an adjustment tool such as a screwdriver. End portion of said adjustment tool may get into contact with the adjustment element (44) and the adjustment piece (32). Power adjustment (43) and the damping adjustment (31) of the furniture hinge (10) is performed by means of rotating the adjustment tool which is capable of getting into contact with the adjustment element (44) and the adjustment piece (32).

As it can be seen in FIG. 3, said power unit (80) comprises a first casing (81) and a second casing (82). Said first casing (81) is connected to at least one of the mounting plates (51) and preferably to both mounting plates (51) in an axially rotatable manner over a third rotating pin (83). Said first casing (81) is in a reservoir form wherein at least one spring (84) may be placed. Said spring (84) may preferably be a compression spring. As it can be seen in FIG. 3, in this embodiment of the present invention, two springs (84) are placed into the first casing (81). The other end of said spring (84) is positioned inside the second casing (82) which is in a reservoir form. Said second casing (82) comprises a connection element (85). The connection element (85) is connected with said holder (86) in a manner in which it can perform a rotational movement therewith.

As it can be seen in FIG. 3, said furniture hinge (10) may comprise an opening angle adjustment (90) on the support piece (70). Final opening position of the furniture door (12) in the upward direction may be changed by means of said opening angle adjustment (90). According to an embodiment of the present invention provided in FIG. 3, said opening angle adjustment (90) comprises a body (91) that is capable of moving linearly by means of axially rotating of an adjusting means (92). Said body (91) is supported on the support piece (70) from a portion thereof in a linearly movable manner and comprises a channel therein in which said adjusting means (92) can be positioned. Said body (91) comprises a detachable (releasable) damper thereon. The furniture door (12) can be damped by means of said damper while being opened in the upward direction. Said damper moves together with said body (91). Once a stopping element (64) located on the movement arm (60) hits the damper, damping of the furniture door (12) in the upward direction begins. The furniture door (12) reaches its final opening position when the damping course of the damper comes to an end.

Operation of the inventive furniture hinge (10) is disclosed in more detail below. While said furniture door (12) is being switched from open position to closed position, the hinge arm (20) connected thereto rotates counterclockwise, thereby said movement arm (60) also rotates counterclockwise over the first joint (62). Said movement arm (60) pulls the lever arm (40) simultaneously counterclockwise over the second joint (63) and thus, the lever arm (40) rotates counterclockwise on the second rotating pin (41).

During the closing of the furniture door (12), once the first joint (62) has passed the connection line between the second rotating pin (41) and second joint (63), namely once it surpassed the dead spot, spring (84) belonging to the power unit (80) which is connected between the third rotating pin (83) and the lever arm (40) applies a pulling force to the furniture door (12). Thus, the user can easily switch the furniture door (12) from the open position to the closed position. At this point, slamming of the furniture door (12) to the furniture body (11) is prevented by means of the damping element (33) that becomes activated when the protrusion (22) located on the hinge arm (20) comes into contact with the support surface (34) on the sliding element (30).

Inversely, when it is desired to switch the furniture door (12) from the closed position to open position, said furniture door (12) and accordingly the hinge arm (20) must be drawn back until the force in the power unit (60) is exceeded, namely until the first joint (62) surpasses the connection line between the second rotating pin (41) and the second joint (63). Once the first joint (62) has surpassed the connection line between the second rotating pin (41) and the second joint (63), the force applied by the power unit (80) becomes reversed, thereby retaining the furniture door (12) in the open position again.

Said power unit (80) is capable of securely retaining said hinge arm (20) of the inventive furniture hinge (10) and accordingly the furniture door (12) in any intermediate position between the closed position and the open position (or vice versa).

Final opening position of the furniture door (12) in the upward direction is changed by the opening angle adjustment (90) that is supported by means of the support piece (70). Once the stopping element (64) located on the movement arm (60) hits the damper which positioned on the body (91), damping of the furniture door (12) in the upward direction begins. When the damper comes to the end of the damping course, the furniture door (12) reaches the final opening position. Linear position of the body (91) and hence, the linear position of the damper can be adjusted by means of the adjusting means (92). Thus, both damping point of the furniture door (12) and the final opening position of the furniture door (12) in the upward direction can be changed

The invention claimed is:

1. A furniture hinge configured to provide movement of a furniture door between open and closed positions on a furniture body, the furniture hinge comprising;

a housing;

a hinge arm including a first end and a second end, the first end of the hinge arm being configured to be connected to the furniture door, the second end of the hinge arm being rotatably connected to the housing;

a lever arm including a power adjustment, the lever arm rotatably connected to the housing;

a movement arm including a first end and a second end, the first end of the movement arm being rotatably connected to the hinge arm, the second end of the movement arm being rotatably connected to the lever arm;

a power unit rotatably connected to the lever arm and rotatably connected to the housing, the power unit including at least one spring configured to generate a spring force against the lever arm and through the movement arm to the hinge arm;

a damping element including a cylinder, the damping element located on the lever arm and configured to dampen movement of the furniture door in a closing direction; and a damping adjustment located on the lever arm and configured to change a position of the cylinder and a damping course of the damping element relative to the lever arm.

2. The furniture hinge of claim 1, wherein the damping adjustment includes:

a sliding element configured to move linearly on the lever arm; and an adjustment piece configured to change a position of the sliding element with respect to the lever arm.

3. The furniture hinge of claim 2, wherein:

the sliding element is mounted on the lever arm and configured to move with the adjustment piece.

4. The furniture hinge of claim 2, wherein:

the sliding element is mounted on the lever arm and configured to move linearly on the lever arm in an opposite direction from a direction in which the adjustment piece is adjusted relative to the sliding element when the damping course is adjusted.

5. The furniture hinge of claim 1, further comprising:

a sliding element mounted on the lever arm and configured to move with the cylinder of the damping element.

6. The furniture hinge of claim 1, wherein:

the power adjustment includes an adjustment element configured to change a connection point between the power unit and the lever arm.

7. The furniture hinge of claim 1, wherein:

the power adjustment includes a threaded screw positioned on the lever arm in an endless rotatable manner, and a holder movably received on the threaded screw.

8. The furniture hinge of claim 1, wherein:

the power unit is configured to keep the hinge arm in any intermediate position between the closed position and the open position.

9. The furniture hinge of claim 1, further comprising:

an opening angle adjuster configured to adjust a fully open position of the furniture door.

10. The furniture hinge of claim 1, further comprising:

a damper configured to dampen movement of the furniture door in an opening direction.

* * * * *